United States Patent [19]

Wittenborg

[11] Patent Number: 4,498,603

[45] Date of Patent: Feb. 12, 1985

[54] VENDING MACHINE COMPRISING AT LEAST ONE DRUM

[75] Inventor: Poul E. Wittenborg, Odense, Denmark

[73] Assignee: Wittenborgs Automatfabriker A/S, Odense, Denmark

[21] Appl. No.: 417,925

[22] Filed: Sep. 14, 1982

[30] Foreign Application Priority Data

Nov. 3, 1981 [DK] Denmark ..... 4846/81

[51] Int. Cl.[3] ..... G07F 11/54

[52] U.S. Cl. ..... 221/76; 49/114; 221/120; 221/155; 312/97.1

[58] Field of Search ..... 221/12, 76, 119, 120, 221/121, 122, 130, 132, 155, 281; 312/97.1; 49/39, 114; 109/67, 68

[56] References Cited

U.S. PATENT DOCUMENTS

| | | | |
|---|---|---|---|
| 3,001,411 | 9/1961 | Wittenborg | 221/76 X |
| 3,107,815 | 10/1963 | Wittenborg | 221/120 X |
| 3,122,401 | 2/1964 | Johnson | 221/120 X |
| 4,391,388 | 7/1983 | Krakauer | 221/76 |

*Primary Examiner*—F. J. Bartuska
*Attorney, Agent, or Firm*—Ladas & Parry

[57] ABSTRACT

A vending machine comprising at least one drum pivotably mounted about a vertical shaft comprises a front pane permitting the customer to view the articles contained in the drum. In order to increase the utilization of the compartments of the drum and the use of compartments of many different sizes, the front pane comprises an outer pane and an inner pane. The inner pane is pivotably mounted about the same axis as the drum. The outer pane covers the entire stack of drums, whereas each drum is associated with one inner pane. Each inner pane comprises a first pawl engaging a pin which is associated with each partition. This pawl may be made to disengage the pin by means of a releasing mechanism which is activated when the drum in question is activated by a switch. At the same time the outer pane is caused to rotate clockwise about the axis, which movement the inner pane is caused to follow as a consequence of a first dog engaging the outer pane. This following of the inner pane is stopped when the first pawl engages the first pin which it meets. In this position, an article may be removed from the drum. The closing is performed by the outer pane being turned counter-clockwise backwards into the closing position, whereby the inner pane and the drum retained by the pawl follow the movement as a consequence of the outer pane engaging a second dog on the inner pane. During the opening movement the drum is fixedly retained by a second pawl engaging a pin. During the closing and turning movement of the drum, this pin disengages the second pawl.

8 Claims, 11 Drawing Figures

VENDING MACHINE COMPRISING AT LEAST ONE DRUM

Figure 1:
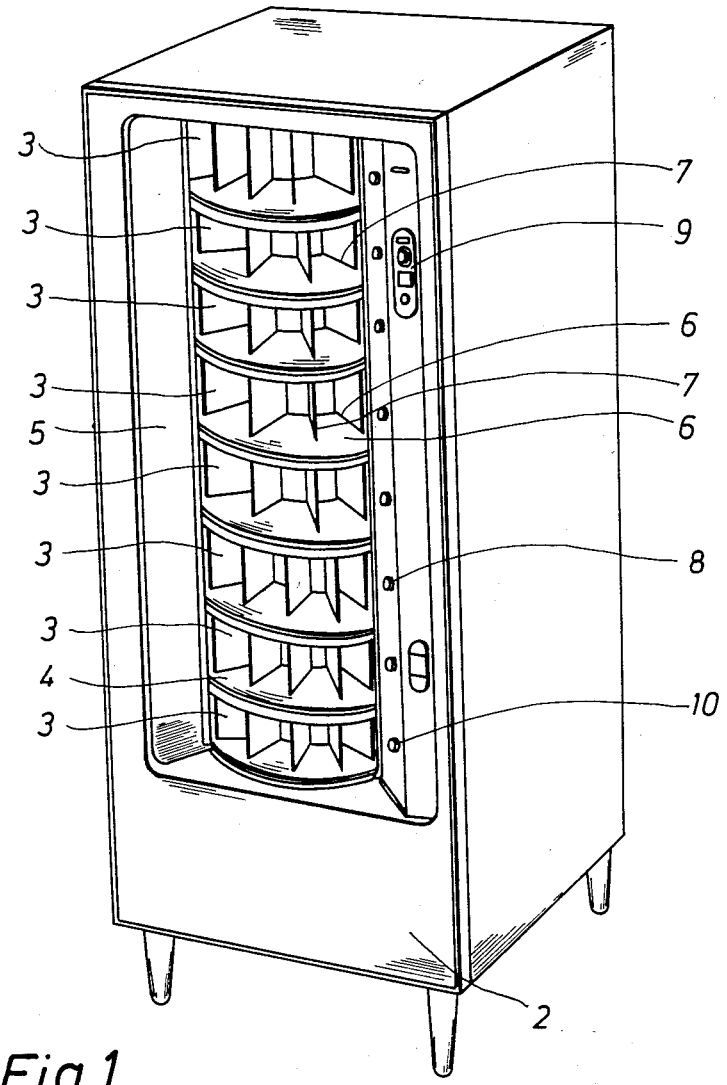

The invention relates to a vending machine comprising at least one drum pivotably mounted about a vertical shaft and provided with vertical partitions defining a discharge opening at the periphery of the drum, through which opening an article is removable when a customer has activated the vending machine in an appropriate manner, said vending machine furthermore comprising a front pane rendering it possible for the customer to see the articles contained in the drum.

Various vending machines are known which comprise a row of drums situated on top of each other and pivotably mounted about a vertical axis, and whereby the content of the drums may be viewed through a front pane. These vending machines comprise a discharge station situated at one side of the machines. This discharge station comprises a pane always openable into a row of compartments situated on top of each other within the drum so as to permit removal of an article from one of the compartments. Since this pane is always openable, the vending machine requires an empty compartment on each column, which opposes the openable pane when the vending machine is not activated. Such a vending machine furthermore implies that the compartments on each drum are of a size corresponding to the width of the opening of the discharge station. When one of the drums is activated, a filled compartment is turned into the discharge station, thus permitting removal of the article.

The object of the invention is to provide a vending machine permitting a better utilization of the drums as well as use of drums comprising discharge openings, which may be of different peripheral length both from one drum to the other and within the same drum.

This object is obtained by the vending machine according to the invention being characterized by the features stated in claim 1.

As a result, all the drums may be filled with articles in all the compartments, and these compartments may be of different sizes, whereby one and the same drum may contain articles requiring different sizes of the discharge opening. This is due to the fact that only the inner pane of the front pane is opened, which is associated with the drum containing the desired article, whereas the inner panes of all the remaining drums remain closed. In addition, the inner pane, which is associated with the drum containing the desired article, can only be opened until the discharge opening in question is freely open. The opening of the inner pane is performed by means of the outer pane covering all the drums. This outer pane is opened the predetermined first distance which is greater than the greatest peripheral extension of the discharge openings. The release and securing of the inner pane is ensured by means of the catching means of each inner pane. These catching means are released when the customer activates the drum in question. Automatically these catching means engage the abutting means associated with the partition of the discharge opening in question and which is firstly met by the catching means during the opening movement. Furthermore, the catching means retain these abutting means during the closing movement of the pane in question in such a manner that the drum follows said movement and turns a distance corresponding to the peripheral extension of the discharge opening.

According to the invention the outer and each inner pane may be pivotably mounted about their respective mutually staggered axes of rotation, whereby it is rendered possible that the panes in the closed position may sealingly abut a sealing strip.

According to the invention the first dog of each inner pane may particularly simply be a resilient, projecting, axially extending member extending along the edge of the pane, which is positioned adjacent the opening direction, whereas the second dog is an axially extending, projecting, fixed member extending along the edge of the pane, which is positioned adjacent the closing direction.

Furthermore according to the invention the catching means may be particularly simple, in connection with each inner pane comprise at least one first pawl pivotably mounted about a vertical shaft on the horizontal part(s) connecting the pane with the shaft of rotation, said pawl being spring-loaded in one direction of rotation and comprising a recess for engaging a pin which is present on the partition(s) and which projects in a vertical direction into the path of the first pawl, and the vending machine may comprise a releasing means associated with each first pawl, said releasing means at activation of the chosen mechanism of the vending machine being adapted to disengage the pawl from the pin in such a manner that the chosen inner pane may freely follow the outer pane in the opening direction, or in such a manner that the drum, if desired, may rotate freely while the panes are closed.

According to the invention it is particularly preferred that each drum is secured during the opening movement of the panes by means of at least one second pawl, which at termination of the closing movement automatically engages the same pin as the first pawl engages during the closing movement, whereas it automatically disengages the pin in question during the rotation of the drum in the same direction as the panes follow during the closing movement. As a result the drum is secured in a simple manner during the opening of both the outer and the inner pane.

Figure 2:
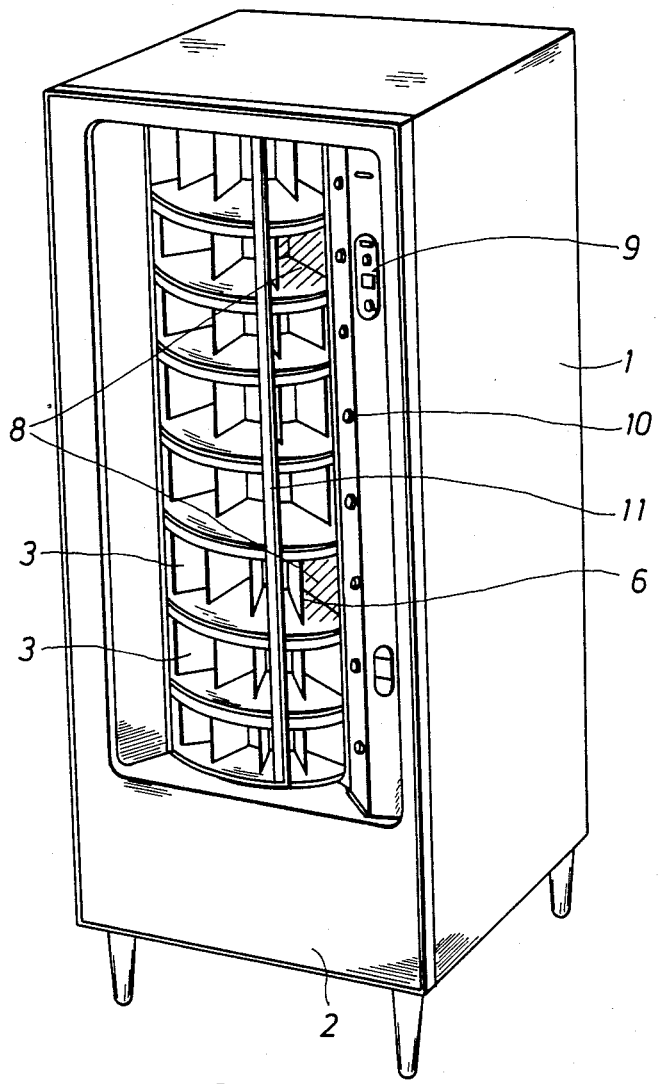
Figure 3:
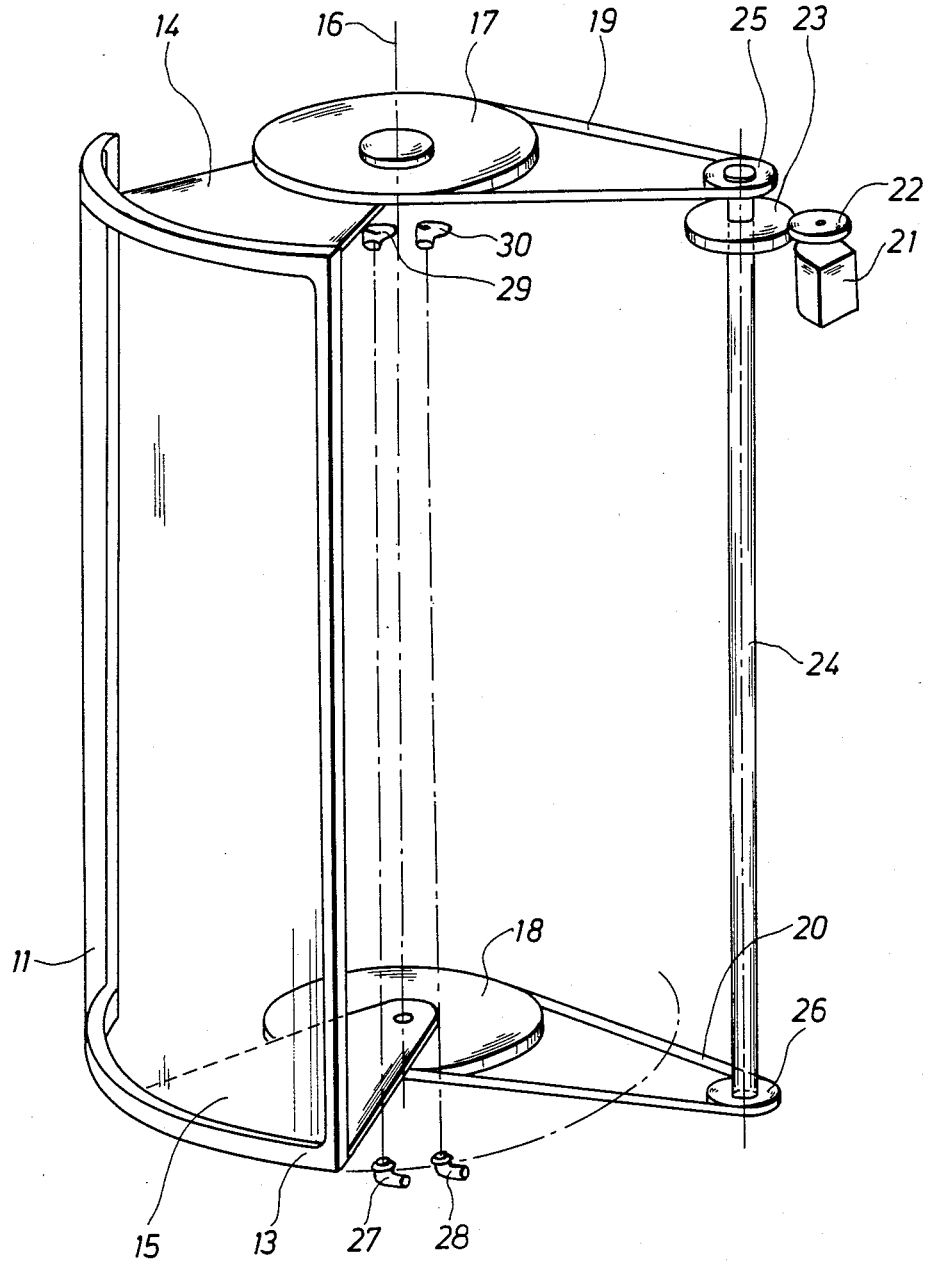
Figure 4:
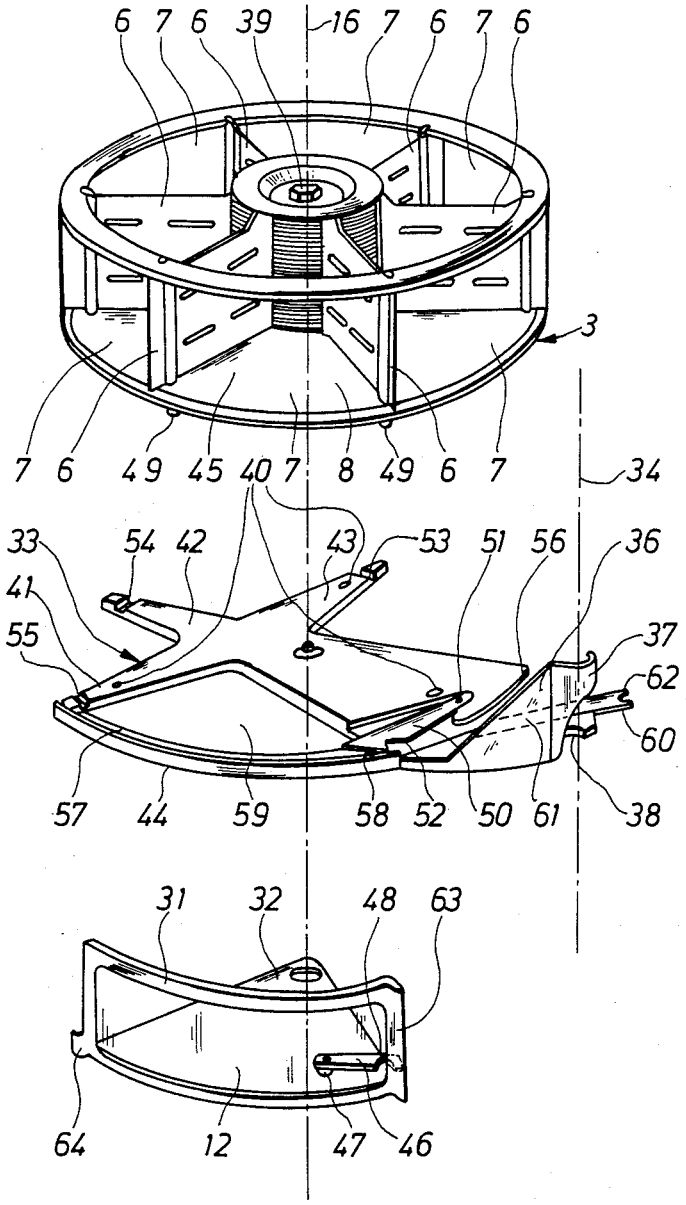
Figure 5:
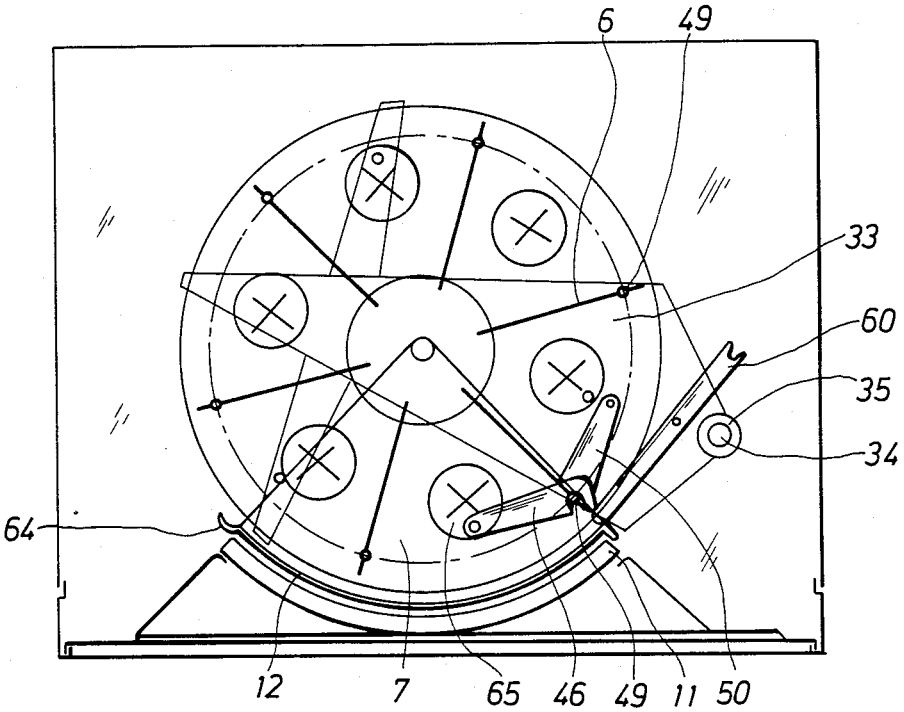
Figure 10:
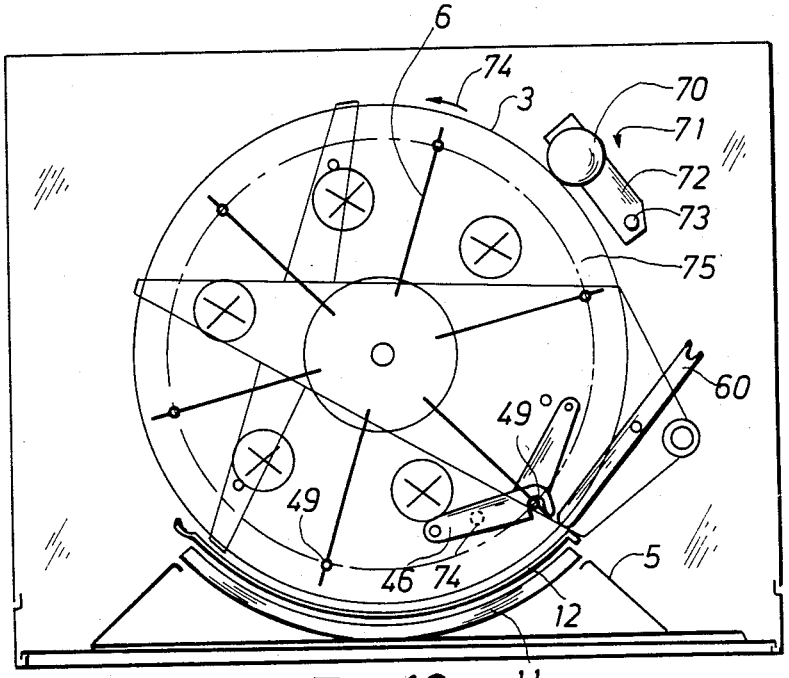
Figure 11:
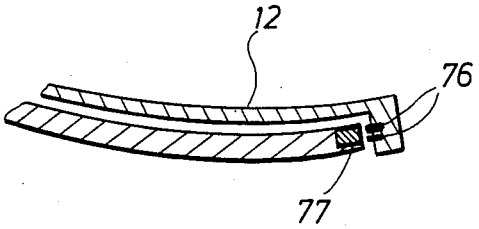

The invention will be described below with reference to the accompanying drawing, in which FIG. 1 is a perspective view of a preferred embodiment of a vending machine according to the invention, whereby the front pane is closed, FIG. 2 corresponds to FIG. 1, but whereby the front pane is illustated in a position in which it is about to be opened, FIG. 3 is a diagrammatic, separate, perspective view of the outer pane of the front pane comprising actuating means, FIG. 4 is a perspective view of a drum with associated swivel arm and inner pane, whereby the individual parts have been separated for the sake of clarity, FIG. 5 is a diagrammatic, horizontal, sectional view through a vending machine according to the invention, seen immediately above a drum, but with usually hidden catching means and releasing means indicated by solid lines for the sake of clarity, all parts being illustrated in a situation in which the drum in question is inactivated, FIGS. 6 to 10 illustrate the vending machine of FIG. 5 in various positions shown in succession from the activation by the customer of the vending machine (FIG. 6) to the complete opening of the discharge opening (FIG. 8) of the drum in question and followed by the final closing of the vending machine so as to prepare it for another activation (FIG. 10), and FIG. 11 is a horizontal, sectional view through part of the outer and an inner pane of a second embodiment of the invention.

The embodiment of a vending machine illustrated in the drawing is shaped as a case 1 with a door 2, through which it is possible to reach the interior of the vending machine. The case 1 comprises a stack of drums 3 pivotably mounted about a vertical axis. Anteriorly it is possible to view this stack of drums through a front pane 4 in an opening 5 in the door 2. Each drum 3 comprises radial partitions dividing each drum 3 into compartments 7, cf. especially FIGS. 1 and 4, receiving their respective article. Along the periphery of the drum, these compartments comprise a discharge opening 8, through which the article in question may be removed when the vending machine has been activated in an appropriate manner as described below. As illustrated in FIGS. 1 and 2, the door of the case 1 comprises means, through which the customer may activate the vending machine for instance by inserting an appropriate amount of money in a coin slot 9 and performing the desired choice of article by activating a selector switch 10 opposite each drum.

The front pane 4 is formed by an outer pane 11, cf. FIG. 3 and inner panes 12, cf. especially FIG. 4, one inner pane being associated with each drum 3. As illustrated in FIG. 3, the outer pane 11 is curved and of such an extension both in axial and peripheral direction that it covers the entire opening 5 in the door 2 and consequently the entire stack of drums 3 in axial direction, i.e. in vertical direction, in the closed position. The front pane 11 comprises a frame 31 which both at the bottom and at the top is carried by an upper and a lower, respectively, radial bracket 14, and 15, respectively. These supporting brackets are pivotably mounted about the same vertical axis 16 as the drums. The upper and the lower bracket 14 and 15, respectively, are fixedly connected to a pulley 17, and 18, respectively, coaxially with the axis 16. These pulleys co-operate with an upper and a lower driving belt 19 and 20, respectively. At activation of the vending machine these driving belts are driven by a motor 21 through co-operating friction disks 22 and 23 as well as a driven shaft 24 with a driven disk 25 and 26, respectively, at each end.

The movement of the outer pane 11 is controlled by photocells 27, 28, 29, and 30. These photocells register the outer positions of the outer pane 11 and transmit a signal to the motor 21 or to the activating device, not shown, thereof.

As illustrated in FIG. 4, the inner pane 12 is also curved and of an extension, which in peripheral direction corresponds to the peripheral extension of the outer pane 11, whereas in the axial direction it is of an extension corresponding to the height of a drum 3. The inner pane 12 comprises a frame 31 carried by a radially extending supporting bracket 32. This supporting bracket is pivotably mounted about the same axis 16 as the drums 3 and the outer pane 11.

Each drum 3 is associated with an inner pane 12, and each drum 3 with the associated inner pane 12 is carried by a supporting arm or a swivel arm 33. This swivel arm is loosely pivotably mounted about an axis 34 extending parallel to the axis 16 of rotation of the drums outside the stack of drums. The shaft 35 associated with the axis 34 is illustrated in FIGS. 5 to 10. The supporting arms associated with each drum are supported by this shaft 35 in such a manner that each drum may turn outwards from the stack of drums 3 at opening of the door 2 so as to permit removal of the drum in question by means of the swivel arm on the shaft 35, optionally for cleaning. For this purpose the swivel arm comprises appropriately a flange 36 projecting upwards and situated at the part outside the drum. At this part, the flange 36 is integral with a curved part 37 gripping about the shaft 35 at the same time as the shaft 35 is received in a curved recess 38 in the supporting arm 33.

Both the drum 3 and the associated inner pane 12 are pivotably secured to their respective side of the supporting arm 33 by means of for instance a bolt connection, only a bolt 39 thereof being illustrated. The drum 3 is adapted to rotate independently of the inner pane 12 and is situated above the supporting arm 33, cf. FIG. 4. This supporting arm is provided with members 40 projecting upwards and forming supporting points, which contribute to the retaining of the drum 3 in a correct position relative to the axis 16 of rotation. The supporting arm 33 comprises projecting legs 41, 42, and 43 adapted to extend to the area about the periphery of the drum. A shielding member 44 extends between the supporting arm and one leg 41, and in the assembled condition this member is situated immediately adjacent the inner side of the frame 31 of the inner pane 12. This shielding member co-operates with the outer periphery of the drum 3 in such a manner that unauthorized persons cannot reach the area between the bottom 45 of the drum and the supporting arm 33 as well as the supporting bracket 32 of the inner pane.

As illustrated in FIG. 4, the inner pane 12 comprises a catching means in the form of a first pawl 46. At one end this pawl is pivotably mounted about a vertical axis by means of a pin 47 projecting from the supporting bracket 32. this pawl is spring-loaded clockwise by means of a spring not shown, seen from the top relative to FIG. 4. As a result, the second free end of the pawl 46 is pressed outwards towards the frame 31 of the inner pane 12. A recess 48 is shaped on the side of the outer end of the pawl 46 which faces the frame 31. This recess is adapted to receive a pin 49 projecting downwards and situated on the bottom of the drum 3. Such a pin 49 is associated with each partition 6 in such a manner that each pin follows each partition when said partition is moved on the drum along the circumference thereof in a manner described more detailed below.

The pin 47 carrying the pawl 48 is situated on the supporting bracket in such a manner that the pins 49 projecting downwards and associated with the partitions 6 of the drum 3 pass between the pin 47 of the pawl 48 and the frame 31 of the inner pane 12 at the lower portion of said frame when the drum 3 rotates relative to the inner pane 2 or vice versa. The pawl 46 is simultaneously preloaded in such a manner that the recess 48 is automatically turned outwards to engage a pin 49 during its passage unless the pawl 46 is pressed away counter-clockwise in another manner.

The supporting arm 33 carries also a second pawl 50 acting as catching means. This pawl 50 is adapted to rotate about a vertical axis at 51. This pawl furthermore extends substantially in a direction opposite the pawl 46 on the inner pane 12, seen in the peripheral direction relative to the axis 16 of rotation of the drum. The pawl 50 is preloaded by means of a spring not shown in such a manner that it is permanently pressed counter-clockwise to-towards the area of the shielding member 44 of the supporting arm and consequently at the periphery of the drum 3. At the outer end this pawl 50 is also provided with a recess 52 adapted to engage the pins 49 projecting downwards and associated with the partitions 6. The pawl 50 is therefore situated on the supporting arm 33 in such a manner that the pins 49 projecting downwards and situated on the drum pass the pawl in the same radial plane as said pawl and in a circle outside the bearing of the pawl at 51. This is rendered possible by the supporting arm being provided with grooves 53, 54, 55, and 56 on the points where the pins 49 projecting downwards project below the upper side of the supporting arm 33. Correspondingly, the shielding member 44 is shaped in such a manner that it allows passage of the pins 49 projecting downwards across a part 57 projecting in radial direction. As illustrated especially in FIGS. 5 to 10, the recesses 48 and 52 in the outer ends of the pawls 46 and 50 face away from the axis 16 of rotation. The outer end of the pawl 50 is furthermore obliquely cut at 58 in such a manner that the pins 49 automatically press the pawl 50 backwards clockwise when the drum 3 is turned to the right, whereby said pins may pass. When an attempt is made to turn the drum 3 to the left, the pawl 50 engages automatically the first pin 49 and retains said pin, thus preventing further turning of the drum 3 in this direction. The pawls 46 and 50 are situated on the inner pane 12 and the supporting arm 33 in axial direction in such a manner that they are positioned in their respective radial plane relative to the axis 16 when the drum is assembled with the supporting arm and the inner pane, the pawl 46 being situated on top. Consequently, the pin 47 carrying the pawl 46 on the supporting bracket 32 of the inner pane 12 projects upwards through the opening 59 formed between the supporting arm 33 and its shielding member 44. As a consequence thereof, the greatest angle of rotation of the inner pane 12 about the axis 16 relative to the supporting arm 33 is determined by the extension of the opening 59 in the peripheral direction on the place where the pin 47 is positioned in the assembled position. As indicated in FIG. 4 and in FIGS. 5 to 10, the supporting arm 33 also carries a third pawl 60 acting as a releasing means for the pawl 46 of the inner plane 12. This releasing means 60 is therefore pivotably mounted about a vertical axis at 61 and situated in such a radial plane that at activation from the outside it can be turned about the axis at 61, whereby the inner end engages the pawl 46 and pushes said pawl counterclockwise and thereby out of engagement with a pin 49 when said pin engages both the pawl 46 and the pawl 50 simultaneously.

Figure 6:
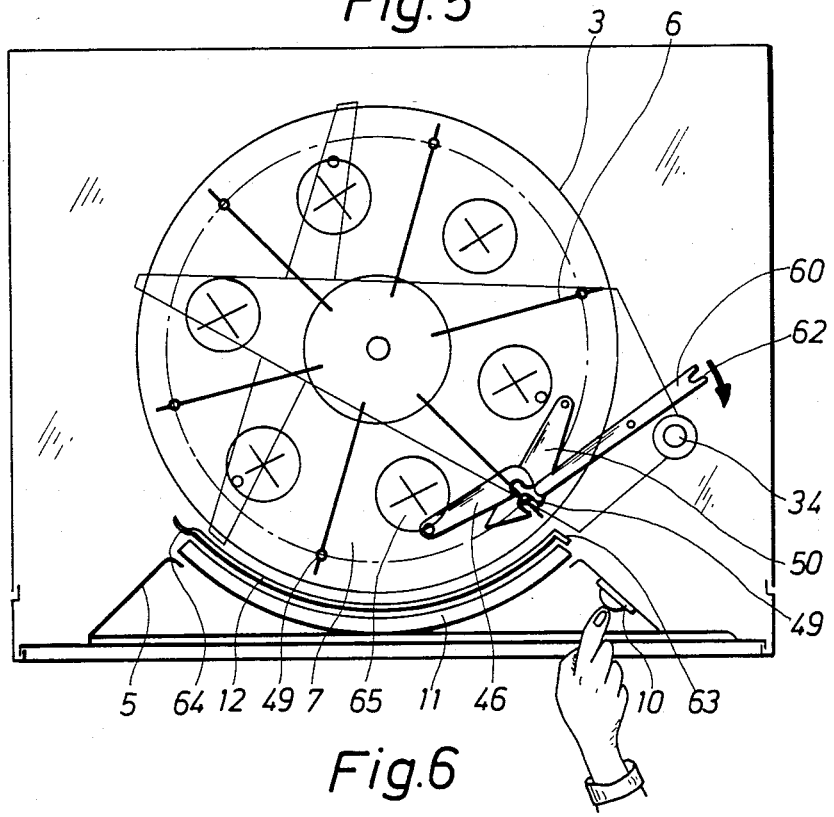

As illustrated especially in FIG. 6, the releasing means 60 and the pawl 46 are positioned in the same radial plane and adapted to co-operate at their outer ends.

As illustrated inter alia in FIG. 4 the outer end of the releasing means comprises a recess 62 adapted to engage the piston of an electro-magnet not shown, said end of the releasing means facing away from the supporting arm 33. This piston permits turning of the releasing means 60 at appropriate activation of the vending machine.

As also illustrated in FIG. 4, the right end of the frame 31 of the inner pane 12, cf. the drawing, comprises a projecting flange 63 projecting into the path of the outer pane 11. Correspondingly, the left end of the frame 31 of the inner pane 12 comprises a part 64 projecting outwards into the path of the outer pane 11. This latter projecting part 64 is of such an extension and made of such a material, e.g. integral with the frame 31, that it acts as a first dog co-operating with the left edge of the outer pane, seen relative to FIG. 3 and FIGS. 5 to 10 and that the inner pane 12 follows the clockwise turning of the outer pane about the axis 16 until the inner pane is secured in a manner described more detailed below. Subsequently, the dog 64 yields to and permits the outer pane 11 to continue its turning. The projecting flange 63 at the right side of the inner pane, seen relative to FIG. 4, is of such an extension that it acts as a second dog during the counterclockwise turning of the outer pane about the axis 16. As a result the inner pane 12 follows the outer pane 11 during this movement and the outer pane 11 is stopped when the inner pane 12 is stopped through co-operation with the two pawls 46 and 50 as well as a pin 49 projecting downwards.

Figure 7:
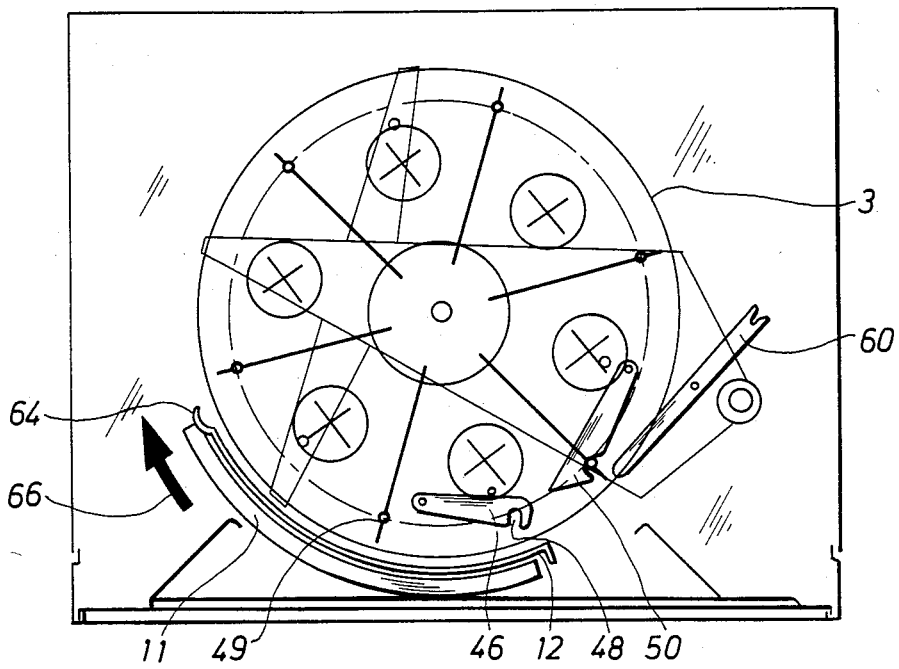
Figure 8:
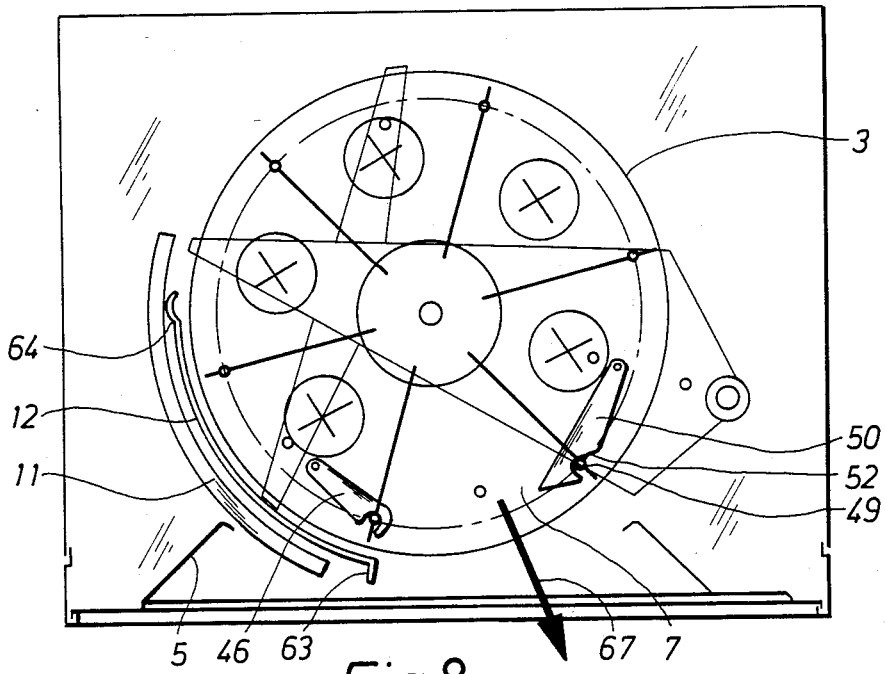
Figure 9:
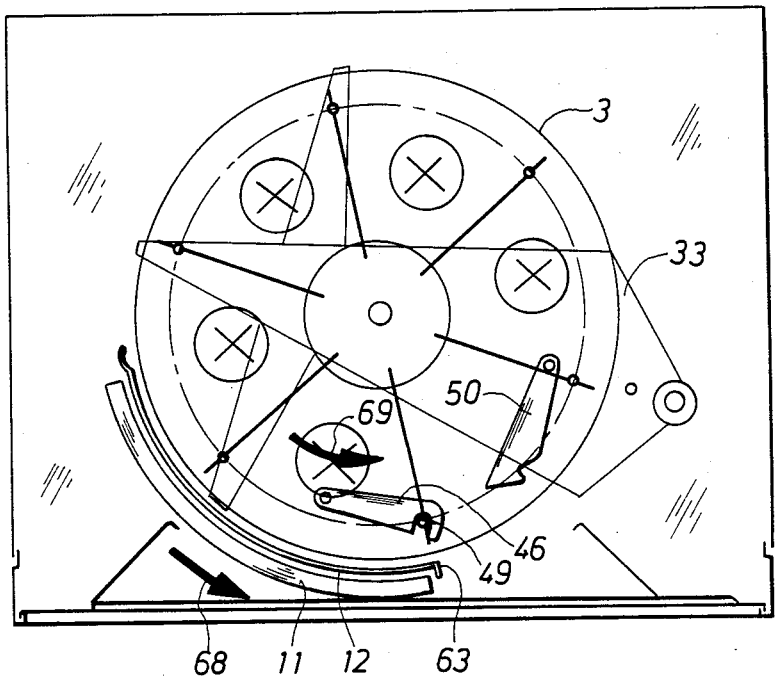

The function of the vending machine is described below with reference to FIGS. 5 to 10 diagrammatically illustrating the inner pane 12 with associated pawl 46, and the supporting arm 33 with the associated pawl 50, as well as the releasing means 60 and the outer pane 11. Only the parts important for the explanation have been provided with reference numerals. FIG. 5 illustrates the individual parts in a situation in which the vending machine has not yet been activated. In this position, the pawl 46 of the inner pane 12 engages a pin 49 simultaneously engaging the pawl 50 of the supporting arm 33. In this position, the outer pane 11 and the inner pane 12 are closed. At the insertion of an appropriate amount of money and at appropriate activation of a selector switch 10, the customer signals to the vending machine to discharge an article 65 present in a compartment 7 adjacent the right side of the opening 5 of the vending machine, seen relative to FIGS. 5 to 10. As a result, the electro-magnet not shown is activated and causes the releasing means 60 to turn and engage the first pawl 46 on the inner pane. In this manner the vending machine is in the position illustrated in FIG. 6, in which the pawl 46 is pushed out of engagement with the adjacent pin 49. However, this pin remains engaging the second pawl 50. Hereby the inner pane 12 may be turned freely clockwise about the drum 3 in question by means of the outer pane 11. As described above, this outer pane is driven by means of a motor 21. FIG. 7 illustrates a position of this turning of the outer pane 11 and the inner pane 12 in the direction indicated by means of an arrow 66. In this position, the outer pane has engaged the first dog 64, whereby the inner pane 12 follows the turning of the outer pane 11. Further in this position, the pawl 46 of the inner pane has disengaged the releasing means 60 and is thereby as a consequence of its spring-loading turned into the path of the pins 49 on the drum 3. As a result, the first pawl 46 on the inner pane 12 engages the first pin 49 met by said pawl during the continued turning, cf. FIG. 8. In this manner the inner pane is secured relative to the drum, whereby the outer pane 11 slides out of engagement with the resilient first dog 64 and continues its movement until it is stopped by stopping means not shown and by signals from the sensing means 27–30 in a position in which its right edge, relative to FIGS. 5–10, opposes the left side of the opening 5. FIG. 8 illustrates the outer pane in the position in which it has disengaged the first dog 64. Subsequently, it is possible freely to remove the article in question from the compartment 7 on the drum 3 which is adjacent the right side of the opening 5, such as illustrated in FIG. 8 by means of an arrow 67.

Later the motor 21 actuates the closing movement of the outer pane 11 at a time optionally determined by a photocell, not shown, registering the removal of the article in question. As a result, the right side of the outer pane 11 engages the second dog 63 and causes the second pane to follow in the direction indicated by means of an arrow 68 in FIG. 9. In this manner the drum 3 also follows the movement of the panes, cf. the arrow 69, since the first pawl 46 maintains its engagement with a pin 49.

This closing and turning movement of the drum 3 continues until the right edge of the outer pane 11 is positioned inside the right side of the opening 5 of the vending machine. In this position, the second pawl on the supporting arm 33 also engages the pin 49 which in advance engages the first pawl 46. In this manner the position of FIG. 10 appears in which the vending machine is ready for another activation. As illustrated especially in FIG. 8, the second pawl 50 comprises a recess 52 of such a shape that the pin 49 which the second pawl 50 engages automatically slides out of the recess 52 and pushed the second pawl 50 backwards in such a manner that the drum may rotate freely in the direction indicated by means of the arrow 69 in FIG. 9.

As indicated in FIG. 10, the periphery of each drum 3 may, if desired, be adapted to frictionally engage a wheel 70, which is rotated by a motor not shown in the direction indicated by means of an arrow 71. This wheel 70 is supported by a frame 72 secured to a shaft 73. This shaft may be rotated at a signal from the outside in a manner generally known whereby the wheel 70 is caused to engage the drum 3 in question at the same time as the releasing means 60 is activated to make the first pawl 46 disengage a pin 49 and away from the path of the pins 49. In this manner the drum is allowed to rotate in the direction indicated by an arrow 74 in FIG. 10 without thereby causing an opening of the vending machine at turning of the outer pane 11. As a result the customer can make the drum 3 rotate until the desired article opposes the opening 5 in the correct position. As a consequence thereof, the drum may contain various articles in their respective compartments. In order to permit a free rotation of the drum 3 during this movement without being stopped by the first pawl 46 each time a pin 49 passes the pawl 46, the releasing means 60 must be of a slightly different shape than the shape indicated in the drawing, so that it can engage and retain said pawl in a position outside the path of the pins 49. For this purpose, the releasing means 60 may be situated on the underside of the supporting arm 33 and be of such an extension that its inner end can engage a pin 74 projecting downwards and indicated in FIG. 10 and which is secured on the first pawl 46.

Since the previously described vending machine as illustrated may function without particular requirements to the distance between the pins 49 projecting downwards on the drum 3, the drums are appropriately adapted in such a manner that the partitions(6) are movable. As a result, the compartments in question on each drum 3 are adjustable as to size. In addition, the bottom of the drum may be provided with orifices at regular intervals along a circle 75 following the periphery of the drum. At the positioning of the partitions in the desired position, the pins 49 associated with the partitions 6 are situated in the orifices associated with the positions.

As indicated in FIG. 2, the discharge opening 8 of both the second and the sixth upper drum, indicated hatched, may be laid open simultaneosly by appropriate activation of the vending machine. This means that only the inner panes 12 associated with these two drums have been caused to follow the outer pane 11 during the opening movement of said outer pane.

Many amendments may be performed without thereby deviating from the scope of the invention. The above catching means may for instance be of many different shapes and be situated in many different positions relative to each drum. The outer and the inner pane may also be pivotably mounted about their respective axes being slightly staggered in such a manner that the two panes in the closed position ensure a particularly good sealing in the vending machine through co-operation with possible sealing strips on the door of the vending machine or on the outer pane 11. The second pawl 50 may furthermore be shaped integral of a resilient material, such a resilient pawl being shaped in such a manner that it operates in the same manner as a pawl made of rigid material with an associated spring not shown.

In addition, the movement of the inner pane may be obtained by the inner pane 12 comprising as above an axially extending projecting member 63 as its second dog, while the first dog is a magnetic material 76 positioned in connection with the projecting member 63. This first dog is adapted to co-operate with a permanent magnet 77 on the edge of the outer pane 11 which is positioned adjacent the closing direction. FIG. 11 illustrates such a permanent magnet 77 at the right edge of the outer pane 11, and the magnetic material 76 is situated in the form of two strips in a projecting member at the right side of an inner pane 12.

I claim:

1. In a vending machine comprising at least one drum pivotably mounted about a vertical shaft and provided with vertical partitions defining a discharge opening at the periphery of each of the at least one drum, through which opening an article is removable when a customer has activated the vending machine in an appropriate manner, said vending machine furthermore comprising a front pane rendering it possible for the customer to see the articles contained in the drum, the improvement comprising that the front pane (4) comprises an outer pane (11) and an inner pane (12) associated with each of the at least one drum, the inner and outer panes being pivotably mounted about a vertical shaft, that the outer pane (11) is connected to a motor (21) so that at activation of the vending machine said outer pane is temporarily opened by being turned a predetermined distance to one side until the customer has removed the desired article, that the inner pane (12) comprises a first and second dog (64, 63), the first (64) of said dogs being adapted to cooperate with the outer pane (11) in such a manner that a chosen inner pane (12) follows at least part of the opening movement of the outer pane (11), the second dog (63) being adapted to co-operate with the outer pane (11) so that the chosen inner pane (12) follows the closing movement of the outer pane, and that one of the inner pane (12) and the parts permanently connected thereto comprises separately releaseable catching means (46) releasably engaging abutting means (49) during the opening movement so that the inner pane (12) is stopped and the discharging opening (8) is laid open, said abutting means being associated with a partition (6) of the discharge opening (8), which is situated adjacent the open position of the outer pane (11) so that the drum follows the inner pane (12) during the closing movement thereof.

2. A vending machine as claimed in claim 1, in which the outer and inner pane (11,12) are pivotably mounted about their respective mutually staggered axes (65) of rotation.

3. A vending machine as claimed in claim 1, in which the outer and the inner panes (11,12) are curved with the centre of curvature on an axis (65) of rotation.

4. A vending machine as claimed in claim 1, in which the first dog (64) of each inner pane (12) is a resilient, projecting, axially extending member extending along the edge of the pane, which is positioned adjacent the opening direction, whereas the second dog (63) is an axially extending, projecting, fixed member extending along the edge of the pane, which is positioned adjacent the closing direction.

5. A vending machine as claimed in claim 1, which the catching means (46) in connection with each inner pane comprise at least one first pawl pivotably mounted about a vertical shaft on the horizontal part (32) connecting the pane with the shaft (65) of rotation, said pawl (46) being spring-loaded in one direction of rotation and comprising a recess (48) for engaging a pin (49), which is present on the partition (6) and which projects in vertical direction into the path of the first pawl (46), and the vending machine comprises a releasing means (60) associated with each first pawl (46), said releasing means at activation of a chosen mechanism of the vending machine being adapted to disengage the pawl (46) from the pin so that the chosen inner pane (12) may freely follow the outer pane (11) in the opening direction.

6. A vending machine as claimed in claim 1, in which each drum (3) is secured during the opening movement of the panes (11, 12) by means of at least one second pawl (50), which at the termination of the closing movement automatically engages the same pin (49) as the first pawl (46) engages during the closing movement, whereas it automatically disengages the pin (49) in question during the rotation of the drum in the same direction as the panes (11, 12) follow during the closing movement.

7. A vending machine as claimed in claim 1, in which the second dog (63) of each inner pane (12) is an axially extending, projecting member extending along the edge of the pane positioned adjacent the closing direction, and the first dog (64) is a magnetic material associated with the second dog (63) and a permanent magnet at the edge of the outer pane positioned adjacent the closing direction for co-operating with the second dog.

8. A vending machine as claimed in claim 1, in which the catching means (46) in connection with each inner pane comprise at least one first pawl pivotably mounted about a vertical shaft on the horizontal part (32) connecting the pane with the shaft (65) of rotation, said pawl (46) being spring-loaded in one direction of rotation and comprising a recess (48) for engaging a pin (49), which is present on the partition (6) and which projects in vertical direction into the path of the first pawl (46), and the vending machine comprises a releasing means (60) associated with each first pawl (46), said releasing means at activation of a chosen mechanism of the vending machine being adapted to disengage the pawl (46) from the pin so that the drum (3) may rotate freely while the panes (11,12) are closed.

* * * * *